United States Patent [19]

Caraba

[11] Patent Number: 5,022,340

[45] Date of Patent: Jun. 11, 1991

[54] PORTABLE MECHANICAL BURGLAR ALARM

[76] Inventor: Budrick S. Caraba, 276 N. El Camino Real #189, Oceanside, Calif. 92054

[21] Appl. No.: 436,693

[22] Filed: Nov. 15, 1989

[51] Int. Cl.[5] ..... G08B 13/08

[52] U.S. Cl. ..... 116/77; 116/86; 116/157

[58] Field of Search ..... 116/77, 86, 91, 155, 116/167, 88

[56] References Cited

U.S. PATENT DOCUMENTS

| | | | |
|---|---|---|---|
| 452,597 | 5/1891 | Davis . | |
| 568,532 | 8/1896 | Hauser . | |
| 589,540 | 9/1897 | Towler . | |
| 1,445,974 | 2/1923 | Rycraft | 116/77 |
| 1,854,126 | 4/1932 | Ferguson | 116/86 |
| 1,859,345 | 5/1932 | Schantz | 116/86 |
| 2,193,452 | 3/1940 | Gauthier | 116/86 |
| 3,921,564 | 11/1975 | Murray . | |
| 3,926,140 | 12/1975 | Bargiel | 116/91 X |
| 3,960,105 | 6/1976 | Ring | 116/167 X |
| 4,067,289 | 1/1978 | Joyner, Jr. . | |

*Primary Examiner*—Daniel M. Yasich

*Attorney, Agent, or Firm*—Jerry T. Kearns

[57] ABSTRACT

A portable mechanical burglar alarm for monitoring doors and windows includes a base plate having a back surface provided with a plurality of suction cups for releasable securement adjacent a door or window. A pair of bells are secured in spaced relation on a front surface of the base plate and a pivotal oscillating clapper arm is disposed therebetween. A spring powered bell ringing mechanism is enclosed by a housing on a front surface of the base plate. A trigger mechanism within the housing is operative to actuate the bell ringing mechanism upon disengagement of an adjustable abutment stop member from contact with a door or window frame upon opening of the door or window. A retaining mechanism within the housing prevents unauthorized resetting of the trigger mechanism subsequent to activation, to prevent the ringing bells from being silenced.

20 Claims, 5 Drawing Sheets

PORTABLE MECHANICAL BURGLAR ALARM

BACKGROUND OF THE INVENTION

1. Field of the Invention

The present invention relates to burglar alarms, and more particularly pertains to a spring powered mechanical portable burglar alarm which does not require the use of electrical power sources or compressed gas canisters.

2. Description of the Prior Art

Various types of burglar alarms are known in the prior art. A typical example of such a burglar alarm is to be found in U.S. Pat. No. 452,597, which issued to C. Davis on May 19, 1891. This patent disclose a portable mechanical burglar alarm for monitoring a door or window. A trigger blade of the alarm is adapted for insertion in the crevice between a door or window and the associated frame. The device includes an oscillating clapper arm powered by a coil spring and gear mechanism. U.S. Pat. No. 568,532, which issued to I. Hauser on Sept. 29, 1896, discloses a combined burglar alarm and call bell having a bell mechanism actuated by a coil spring. U.S. Pat. No. 589,540, which issued to J. Towler on Sept. 7, 1897, discloses a burglar alarm including a mechanical bell clapper actuated by a coil spring and gear mechanism. A release trigger is formed by an elongated adjustable plunger. U.S. Pat. No. 3,921,56 which issued to H. Murray on Nov. 25, 1975, discloses a portable burglar alarm having a housing containing a bell and a spring driven motor. The alarm has an elongated supporting mechanism connected to the housing and operatively coupled to the spring driven motor. The alarm is adapted for leaning the housing against a movable surface, with the elongated supporting mechanism resting on a fixed surface. Relative movement of the movable surface causes the alarm to topple and engage the spring driven motor to mechanically ring a pair of spaced bells. U.S. Pat. No. 4,067,289, which issued to C. Joyner, Jr. on Jan. 10, 1978, discloses a portable mechanical alarm for doors and windows which utilizes a mechanical clapper arm to strike a bell. A trigger arm is operative to activate the bell ringing mechanism.

While the above mentioned devices are directed to portable mechanical burglar alarms, none of these devices disclose the use of a spring powered bell ringing mechanism having a trigger mechanism and a trigger retaining mechanism for preventing unauthorized resetting of the trigger mechanism. Inasmuch as the art is relatively crowded with respect to these various types of burglar alarms, it can be appreciated that there is a continuing need for and interest in improvements to such burglar alarms, and in this respect, the present invention addresses this need and interest.

SUMMARY OF THE INVENTION

In view of the foregoing disadvantages inherent in the known types of burglar alarms now present in the prior art, the present invention provides an improved portable mechanical burglar alarm. As such, the general purpose of the present invention, which will be described subsequently in greater detail, is to provide a new and improved portable mechanical burglar alarm which has all the advantages of the prior art burglar alarms and none of the disadvantages.

To attain this, a representative embodiment of the concepts of the present invention is illustrated in the drawings and makes use of a portable mechanical burglar alarm for monitoring doors and windows which includes a base plate having a back surface provided with a plurality of suction cups for releasable securement adjacent a door or window. A pair of bells are secured in spaced relation on a front surface of the base plate and a pivotal oscillating clapper arm is disposed therebetween. A spring powered bell ringing mechanism is enclosed by a housing on a front surface of the base plate. A trigger mechanism within the housing is operative to actuate the bell ringing mechanism upon disengagement of an adjustable abutment stop member from contact with a door or window frame upon opening of the door or window. A retaining mechanism within the housing prevents unauthorized resetting of the trigger mechanism subsequent to activation, to prevent the ringing bells from being silenced.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseologY and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable mechanical burglar alarm which has all the advantages of the prior art burglar alarms and none of the disadvantages.

It is another object of the present invention to provide a new and improved portable mechanical burglar alarm which may be easily and efficiently manufactured and marketed.

It is a further object of the present invention to provide a new and improved portable mechanical burglar alarm which is of a durable and reliable construction.

An even further object of the present invention is to provide a new and improved portable mechanical burglar alarm which is susceptible of a low cost of manufacture with regard to both materials and labor, and which accordingly is then susceptible of low prices of sale to the consuming public, thereby making such burglar alarms economically available to the buying public.

Still yet another object of the present invention is to provide a new and improved portable mechanical burglar alarm which provides in the apparatuses and methods of the prior art some of the advantages thereof, while simultaneously overcoming some of the disadvantages normally associated therewith.

Still another object of the present invention is to provide a new and improved portable mechanical burglar alarm adapted for monitoring door and window openings.

Yet another object of the present invention is to provide a new and improved portable mechanical burglar alarm which does not require connection to a source of electric current or a compressed air canister.

Even still another object of the present invention is to provide a new and improved portable mechanical burglar alarm including an actuating trigger mechanism and a trigger retaining mechanism for preventing unauthorized resetting of the trigger mechanism subsequent to activation of the alarm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
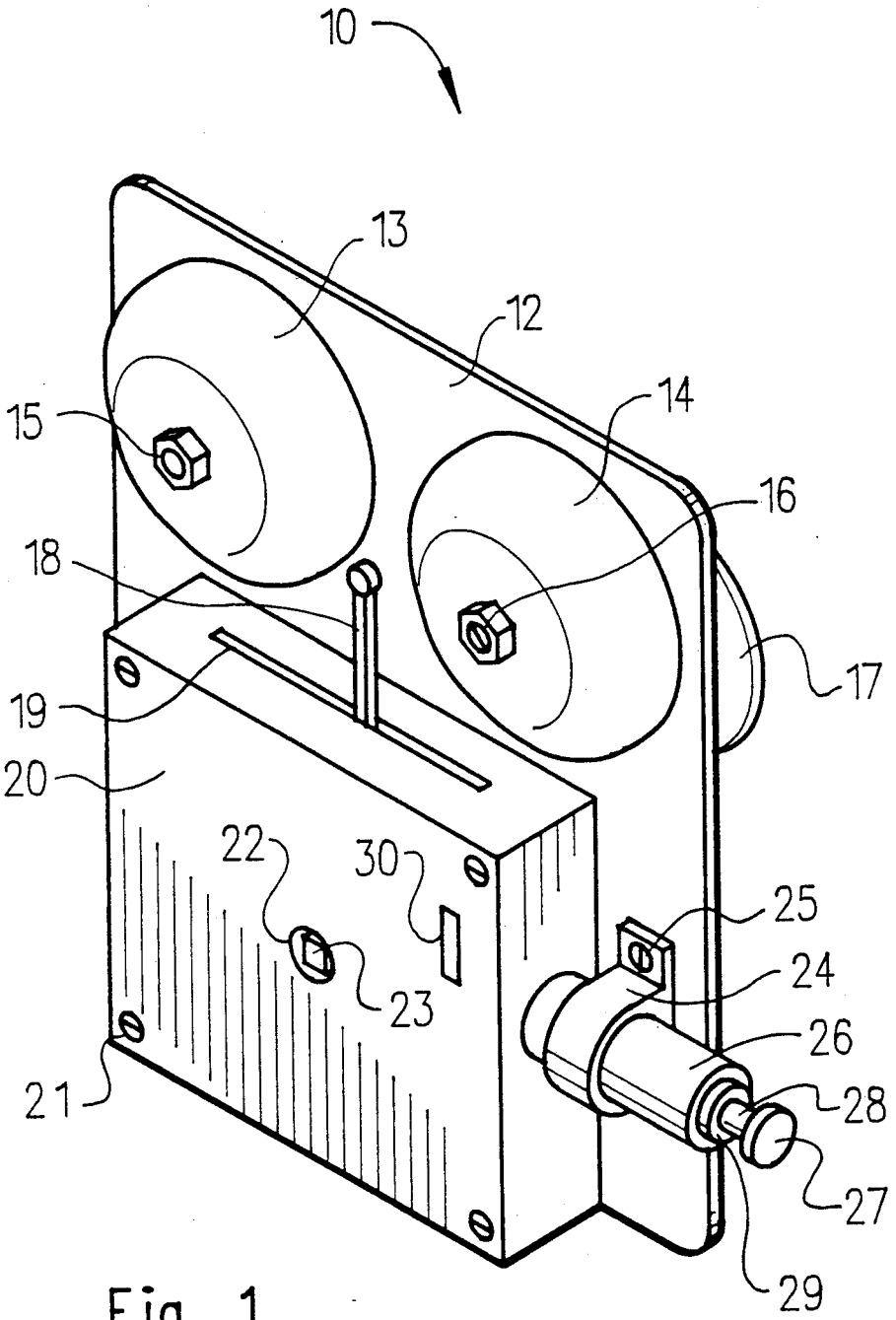
FIG. 1 is a front side perspective view of the burglar alarm according to the present invention.

With reference now to the drawings, and in particular to FIG. 1 thereof, a new and improved portable mechanical burglar alarm embodying the principles and concepts of the present invention and generally designated by the reference numeral 10 will be described.

More specifically, it will be noted that the first embodiment 10 of the invention includes a base plate 12, preferably formed from a metal material and having a pair of conventional bells 13 and 14 secured thereon through the use of conventional threaded fasteners 15 and 16. One or a plurality of suction cups 17 are secured on a back face of the base plate 12, for securing the alarm 10 onto or adjacent a door or window to be monitored. A pivotal oscillating bell clapper arm 18 is disposed between the bells 13 and 14, and is adapted to ring the bells upon activation of the alarm. The clapper arm 18 extends through a slot 19 formed in the top wall of a generally rectangular housing 20. The housing 20 is secured to the plate 12 by a plurality of screws 21. A circular aperture 22 is formed in a front wall of the housing 20 and provides access to a rectangular winding shaft 23. The aperture 22 allows connection of a winding key with the shaft 23 in order to wind an internal coil spring. A slot 30 is also formed through the front wall of the housing 20 to provide a limited access to disable the alarm subsequent to actuation. A plunger 29 is mounted for axial movement within a sleeve 26 which is secured by a bracket 24 to the front face of the plate 12 by screws 25. An adjustable stop 27 includes a shaft portion 28 disposed in coaxial threaded engagement with the plunger 29.

Figure 2:
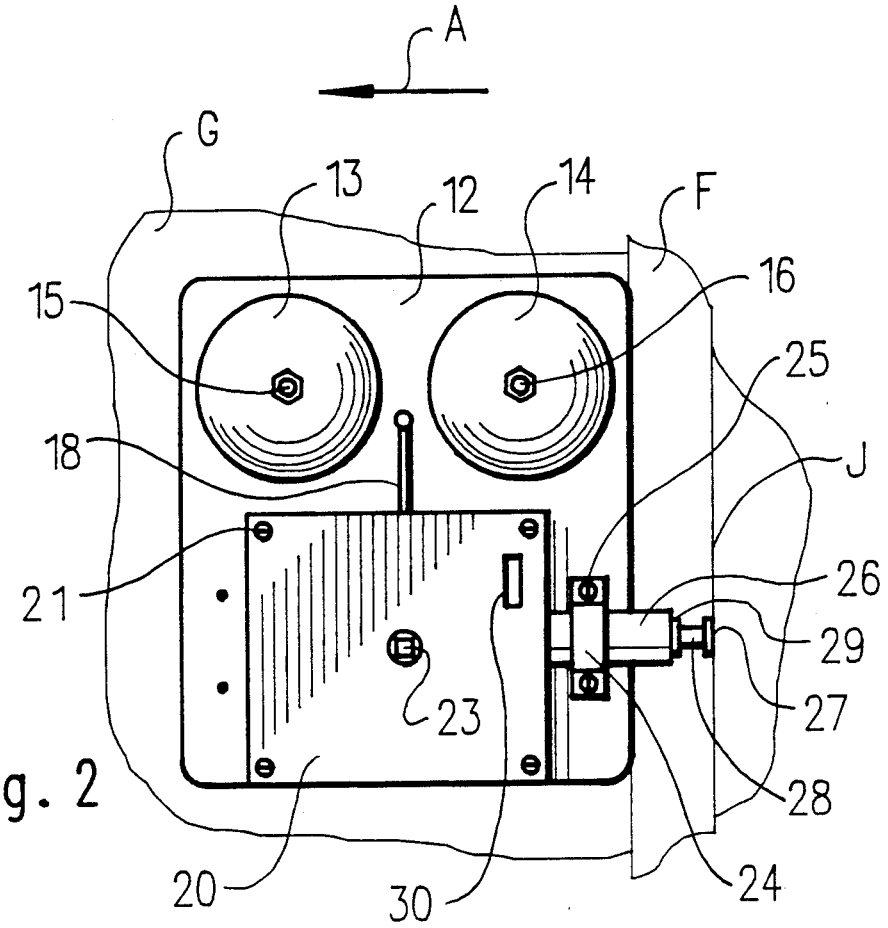
FIG. 2 is a front view illustrating the burglar alarm installed on a horizontally sliding door.

As shown in FIG. 2, the base plate 12 may be secured by the suction cups provided on the back surface of the plate 12 to the glass G of a sliding door. The abutment stop 27 extends pass the movable frame F of the sliding door and into abutment with the stationary door casing or jam J. When the sliding door G is moved to the left as indicated by arrow A, an internal spring will cause the trigger plunger 29 to extend from within the sleeve 26 under the bias of an internal coil spring, thus actuating an internal bell ringing mechanism to cause oscillation of the clapper arm 18 and thus ringing of the bells 13 and 14.

Figure 3:
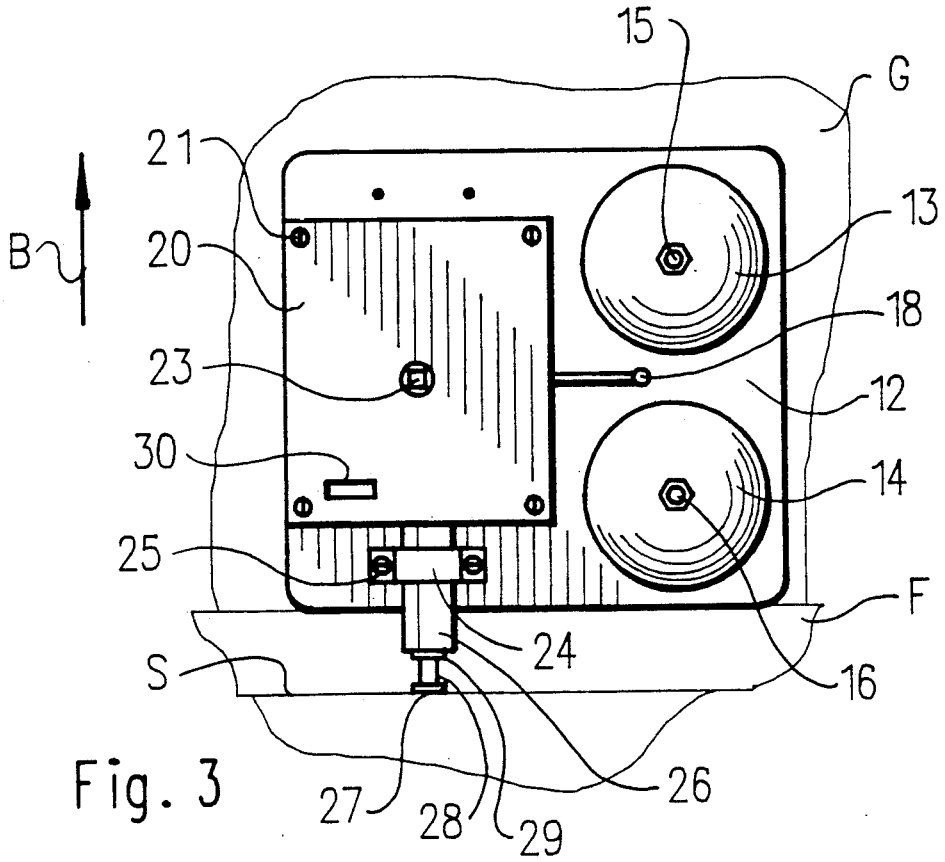
FIG. 3 is a front view illustrating the burglar alarm installed on a vertically sliding window.

FIG. 3 illustrates an alternative mounting of the base plate 12 on the glass G of a vertically sliding window. When the window glass G is moved upwardly in the direction of the arrow B, the stop 27 will be moved out of engagement with the window sill S, thus triggering the bell ringing mechanism. Although the alarm has been described as being secured to the movable portion of a door or window opening, it should be noted that the base plate may alternatively be secured to a stationary surface adjacent a movable door or window, and the trigger stop 27 may be placed into abutment with a movable frame portion of the door or window.

Figure 4:
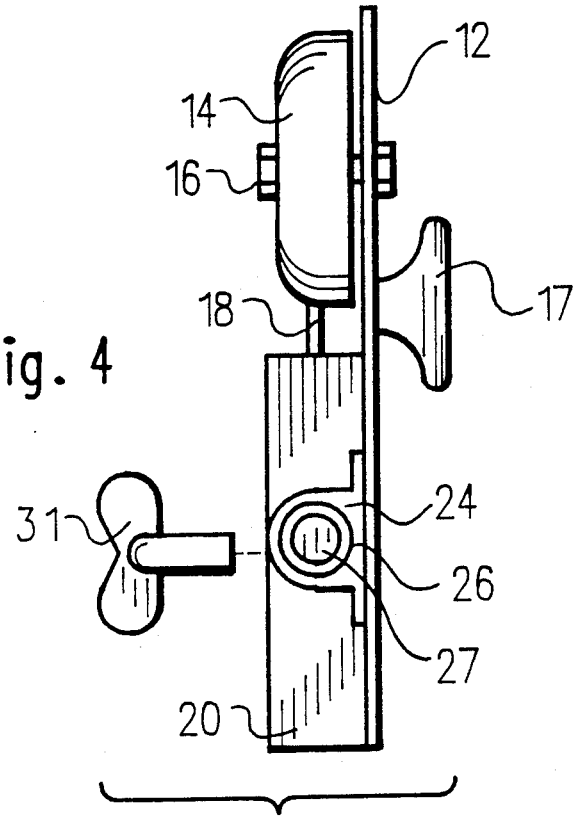
FIG. 4 is a side view illustrating the burglar alarm according to the present invention.

FIG. 4 illustrates a winding key 31 which may be inserted through the front face of the housing 20 to wind an internal coil spring. The shaft of the key 31 includes a rectangular recess dimensioned for engagement with the rectangular winding shaft 23 illustrated in FIG. 1.

Figure 5:
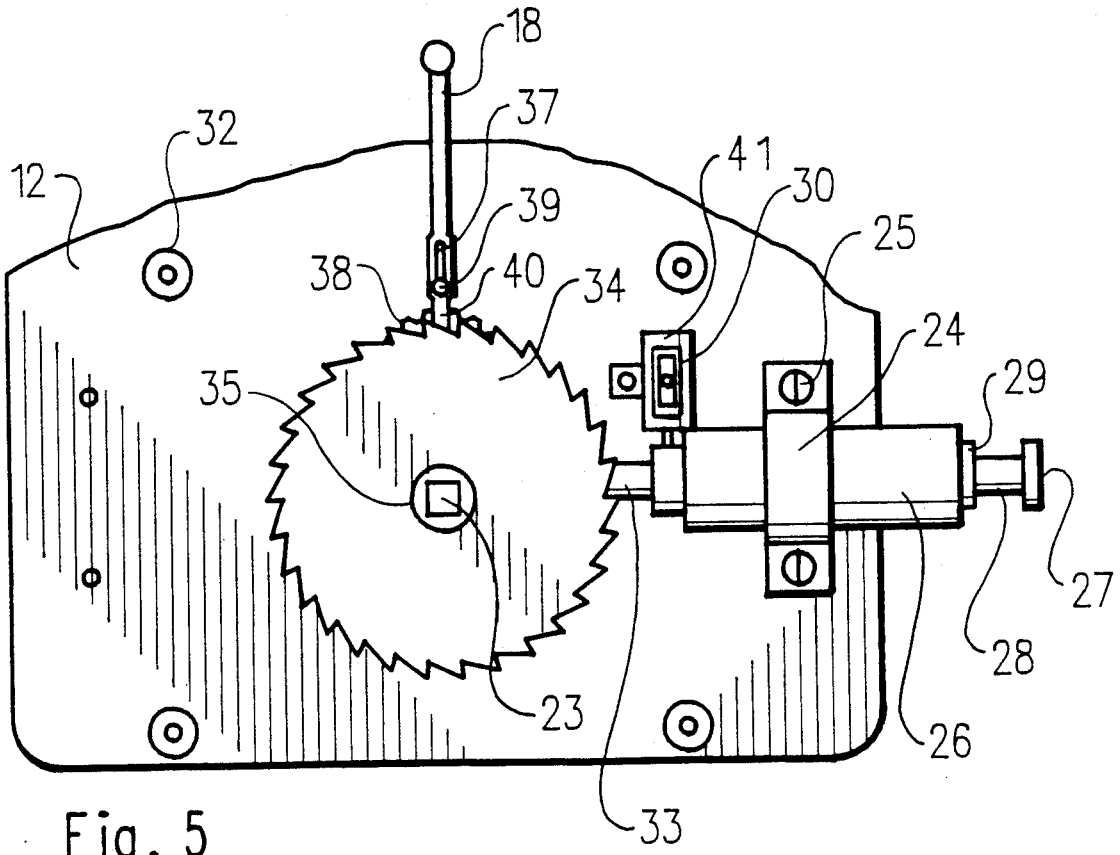
FIG. 5 is a partial front detail view, illustrating the construction of the bell ringing and alarm trigger mechanisms of the burglar alarm according to the present invention.

FIG. 5 illustrates a portion of the front surface of the base plate 12, with the housing 20 removed. The rectangular winding stub 23 is formed at an outer end of a rotary shaft 35 upon which a ratchet wheel 34 is keyed for concurrent rotation. An inclined end portion 33 of the plunger 29 is disposed in engagement with the teeth of the ratchet wheel 34, thus preventing rotation of the wheel 34 and shaft 35. A cylindrical sleeve 41 serves as a housing for a trigger retaining mechanism which prevents the inclined end portion 33 from moving back into engagement with the ratchet wheel 34, after it has been initially disengaged.

Figure 6:
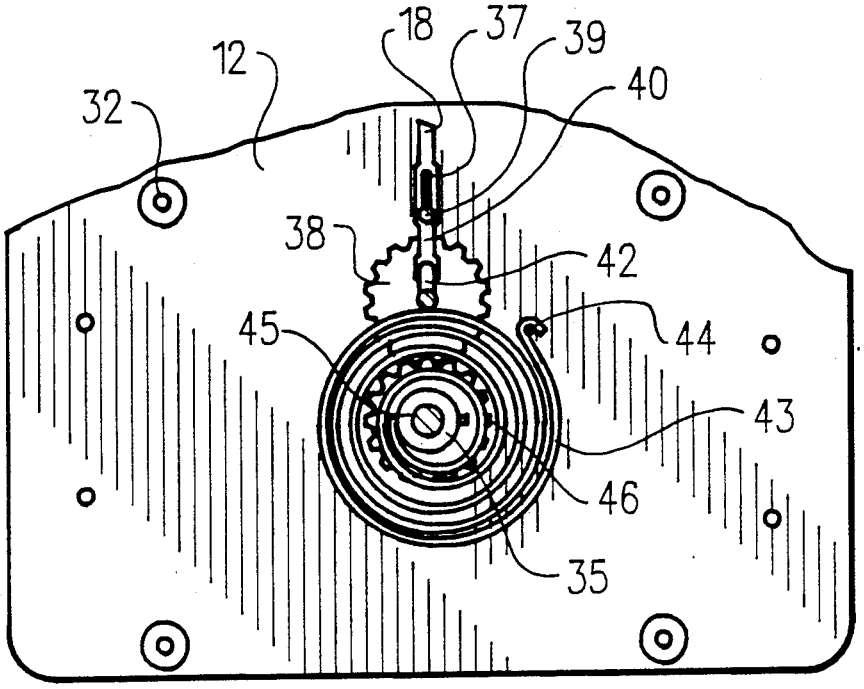
FIG. 6 is a further front detail view, illustrating the coil spring and gear bell clapper actuating mechanism.

As shown in FIG. 6, the retaining shaft 35 is surrounded by a coil spring 43 which has a first hook end portion 44 secured to the front surface of the plate 12 and a second end portion 45 secured to the shaft 35. Thus, the spring 43, when wound, provides a rotary drive for the shaft 35. A first gear 46 is keyed for rotation with the shaft 35 and is disposed in mesh with a second gear 38. The second gear 38 is mounted for rotation on a rotary offset crank arm 42. A lower end portion 40 of the clapper arm 18 is secured to an offset portion of the crank arm 42. This securement is effected by providing an aperture through the lower end portion 40 through which the crank arm 42 is received with clearance. An intermediate portion of the crank arm 18 is provided with an elongated slot 37 which receives a stationary pivotal mounting shaft 39 with clearance. A plurality of bosses 32 are provided on the plate 12 for engagement with the screws 21 illustrated in FIG. 1, to effect securement of the housing 20 over the bell ringing mechanism components.

Figure 7:
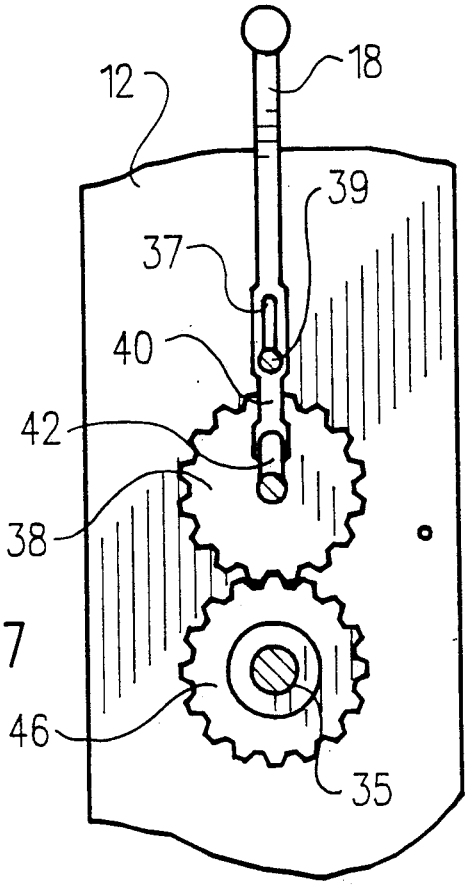
FIG. 7 is a further front detail view, illustrating the construction of the bell clapper actuating mechanism.

FIG. 7 illustrates the bell ringing mechanism, with the coil spring removed. The gears 46 and 38 are in meshing engagement such that rotation of the shaft 35 caused by unwinding of the coil spring 43 (FIG. 6) causes the gear 46 to drive the gear 38, thus effecting rotation of the offset crank arm 42. Rotation of the crank arm 42 causes an oscillating movement to be imparted to the clapper arm 18.

Figure 8:
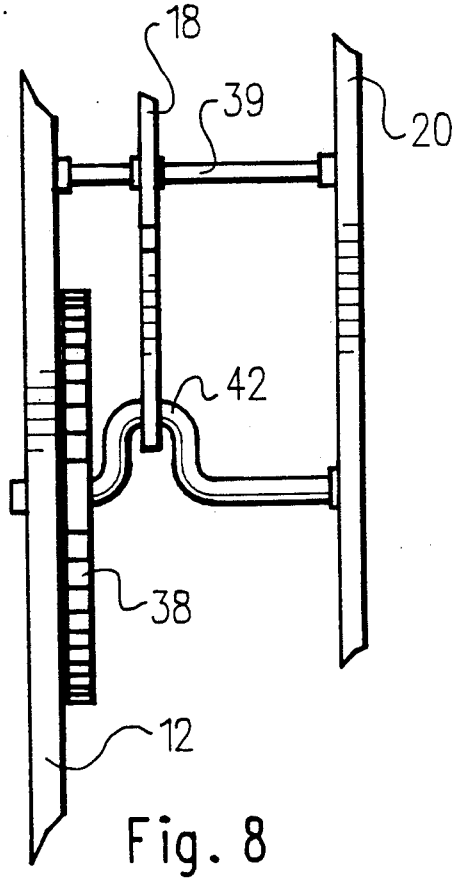
FIG. 8 is a side view of the bell clapper actuating mechanism details illustrated in FIG. 7.

FIG. 8 is a side view which illustrates the offset rotary crank arm 42 supported for rotation between the front surface of the base plate 12 and the interior front wall of the housing 20. The stationary pivotal mounting shaft 39 is also secured between the plate 12 and the housing 20.

Figure 9:
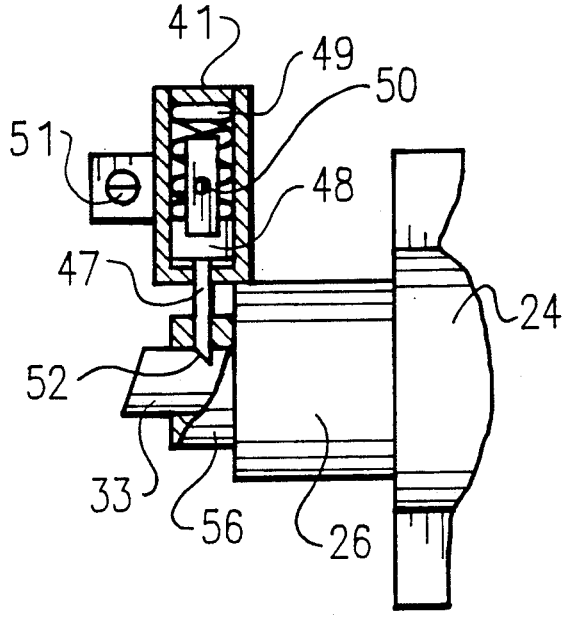
FIG. 9 is a detail view, partially in cross section, illustrating the trigger retaining mechanism.

FIG. 9 illustrates the trigger retaining mechanism which includes the cylindrical housing 41, adapted for securement to the base plate 12 (FIG. 5) by a screw 51. A plunger 48 is received for axial sliding movement within the sleeve 41 and is connected to a retaining pin 47 which extends through an aperture provided in a bottom end wall of the sleeve 41. A coil spring 49 downwardly biases the plunger 48 and retaining pin 47. A slider member 50 is secured to the plunger 48 and includes a circular aperture adapted for engagement with a small element, for example a pinpoint, to effect manual upward vertical movement of the retaining pin 47.- The pin or pinpoint may be inserted through the slot 30 as illustrated in FIGS. 1 and 5. The distal end of the retaining pin 47 is inclined and dimensioned for engagement with a complementary formed recess 52 provided in the trigger plunger end portion 33. Thus, when the trigger end portion 33 is disposed in the illustrated retracted position, the retaining pin 47 will move into engagement with the recess 52, thus preventing the trigger end portion 33 from moving back into engagement with the ratchet wheel 34 (FIG. 5), until the retaining pin 47 is manually released by manipulation of the slider 50. This prevents unauthorized resetting of the alarm subsequent to activation.

Figure 10:
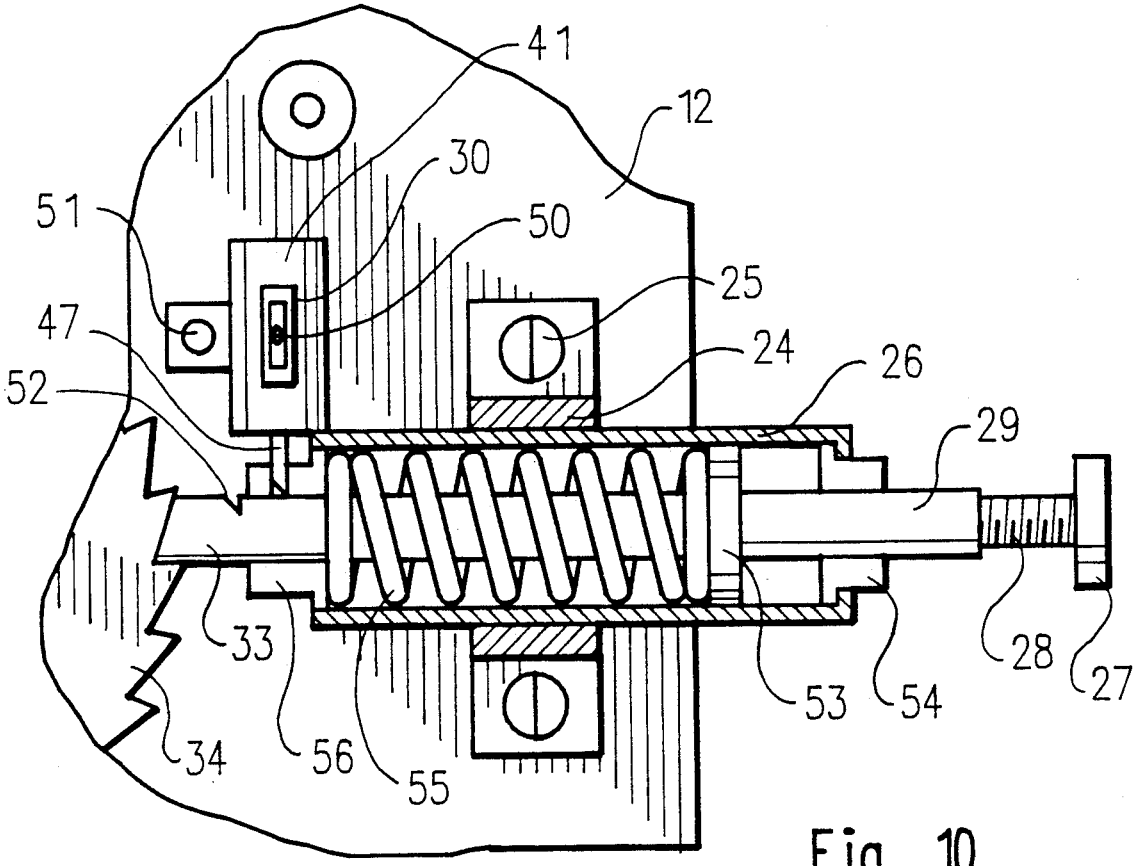
FIG. 10 is a cross sectional detail view, illustrating the construction of the adjustable alarm trigger and trigger retaining mechanism.

FIG. 10 illustrates a cross sectional view of the trigger sleeve 26, illustrating the plunger 29 which is mounted for axial sliding movement within journal bearing members 54 and 56. The retaining pin 47 is slidable within a transverse circular aperture provided in the journal bearing 56, for engagement with the recess 52 provided in the trigger end portion 33. A coil spring 55 is in engagement with a radial flange 53 secured to the plunger 29. The plunger 29 is thus biased to the right in FIG. 10, urging the trigger end portion 33 out of engagement with the ratchet wheel 34. In use, abutment of the stop 27 with a door or window frame prevents disengagement of the trigger end portion 33 from the ratchet wheel 34. When the door or window is opened, the plunger 29 will move to the right of FIG. 10 under the bias of the coil spring 55, thus disengaging the trigger end portion 33 from the ratchet wheel 34, until the retaining pin 47 moves into engagement with the recess 52. The ratchet wheel 34 will then be free to rotate, and the bell ringing mechanism previously described will effect a mechanical ringing of the bell. The alarm device may be adjusted for use in various differently dimensioned window and door openings through the use of the threaded engagement of the shaft 28 within the plunger 29.

Additionally, it should be noted that the bells 13 and 14, as well as the clapper arm 18 illustrated in FIG. 1 may also be enclosed within an enlarged housing, to prevent manual interference with the striking of the clapper 18 on the bells 13 and 14, subsequent to activation of the alarm. As may now be understood, the present invention provides a relatively inexpensive, easily portable alarm which may be installed without requiring modification of existing door or window structures. Additionally, the device does not require the use of electrical power sources or compressed gas canisters.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable mechanical burglar alarm actuated by relative movement of first and second structural members, comprising:

a base plate;

at least one suction cup on a back surface of said base plate for mounting said base plate on a first structural member;

a pair of bells secured in aligned spaced relation on a front surface of said base plate;

a pivotal clapper arm disposed between said bells;

a spring powered bell ringing mechanism operably connected to said clapper arm for striking said arm in an alternating manner against each of said bells;

trigger means mounted on said base plate for actuating said ringing mechanism in response to relative movement between the first and the second structural member; and means coacting with said trigger means for preventing unauthorized resetting of said trigger means.

2. The portable mechanical burglar alarm of claim 1, wherein said bell ringing mechanism comprises a first gear mounted for rotation with respect to said base plate on a rotary shaft;

a coil spring surrounding said rotary shaft, said coil spring having a first end secured to said rotary shaft and a second end secured to said base plate;

a ratchet wheel mounted on said rotary shaft;

a second gear mounted on an offsetting rotary crank arm and in mesh with said first gear;

said clapper arm having an end portion secured to said offset rotary crank arm;

an elongated slot formed in an intermediate portion of said clapper arm; and a pivotal mounting shaft secured to said base plate extending through said slot in said clapper arm, whereby rotation of said rotary crank arm effects a pivotal oscillation of said clapper arm.

3. The portable mechanical burglar alarm of claim 1, wherein said bell ringing mechanism includes a ratchet wheel.

4. The portable mechanical burglar alarm of claim 22, wherein said trigger means includes a plunger movable into engagement with said ratchet wheel.

5. The portable mechanical burglar alarm of claim 4, further comprising a spring biasing said plunger away from said ratchet wheel.

6. The portable mechanical burglar alarm of claim 5, further comprising an abutment stop disposed for abutment with the second structural member for maintaining said plunger in engagement with said ratchet wheel.

7. The portable mechanical burglar alarm of claim 4, wherein said abutment stop is adjustable in length.

8. The portable mechanical burglar alarm of claim 7, wherein said abutment stop is in threaded engagement with said plunger.

9. The portable mechanical burglar alarm of claim 4, wherein said means for preventing unauthorized resetting of said trigger means includes a retaining pin mounted for movement transverse to said plunger;

a recess formed in said plunger dimensioned for engagement with said retaining pin; and a spring biasing said retaining pin toward said plunger, whereby said retaining pin engages said recess in said plunger upon movement of said plunger out of engagement with said ratchet wheel.

10. The portable mechanical burglar alarm of claim 9, further comprising a slide member secured to said retaining pin for manually disengaging said retaining pin from said recess in said plunger.

11. The portable mechanical burglar alarm of claim 10, further comprising a housing enclosing said plunger, said retaining pin and said ratchet wheel; and a slot formed in said housing allowing limited access to said slide member.

12. A portable mechanical burglar alarm for monitoring a door or window, comprising:

a base plate;

at least one suction cup on said base plate for mounting said base plate adjacent to a door or window to be monitored;

at least one bell secured to said base plate;

a spring powered bell ringing mechanism on said base plate for ringing said bell;

trigger means operably mounted on the base plate for actuating said ringing mechanism upon opening of a door or window; and means coacting with said trigger means for preventing unauthorized resetting of said trigger means.

13. The portable mechanical burglar alarm of claim 12, wherein said bell ringing mechanism includes a ratchet wheel.

14. The portable mechanical burglar alarm of claim 13, wherein said trigger means includes a plunger movable into engagement with said ratchet wheel.

15. The portable mechanical burglar alarm of claim 14, further comprising a spring biasing said plunger away from said ratchet wheel.

16. The portable mechanical burglar alarm of claim 15, further comprising an abutment stop disposed for abutment with a door or window for maintaining said plunger in engagement with said ratchet wheel.

17. The portable mechanical burglar alarm of claim 16, wherein said abutment stop is adjustable in length.

18. The portable mechanical burglar alarm of claim 17, wherein said abutment stop is in threaded engagement with said plunger.

19. The portable mechanical burglar alarm of claim 16, wherein said means for preventing unauthorized resetting of said trigger means includes a retaining pin mounted for movement transverse to said plunger;

a recess formed in said plunger dimensioned for engagement with said retaining pin; and a spring biasing said retaining pin toward said plunger, whereby said retaining pin engages said recess in said plunger upon movement of said plunger out of engagement with said ratchet wheel.

20. The portable mechanical burglar alarm of claim 19, further comprising a slide member secured to said retaining pin for manually disengaging said retaining pin from said recess in said plunger;

a housing enclosing said plunger, said retaining pin and said ratchet wheel; and a slot formed in said housing allowing limited access to said slide member.

* * * * *